US009718278B2

(12) United States Patent
Morita et al.

(10) Patent No.: US 9,718,278 B2
(45) Date of Patent: Aug. 1, 2017

(54) IMAGE FORMING APPARATUS AND IMAGE FORMING METHOD

(71) Applicant: CANON KABUSHIKI KAISHA, Tokyo (JP)

(72) Inventors: Akira Morita, Yokohama (JP); Keiichirou Takeuchi, Komae (JP); Eisuke Nishitani, Tokyo (JP); Takumi Otani, Kodaira (JP); Fumihiro Goto, Kawasaki (JP); Koichiro Nakazawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/244,815

(22) Filed: Aug. 23, 2016

(65) Prior Publication Data

US 2017/0057245 A1 Mar. 2, 2017

(30) Foreign Application Priority Data

Aug. 27, 2015 (JP) ..... 2015-167505

(51) Int. Cl.
*B41J 2/21* (2006.01)

(52) U.S. Cl.
CPC ..... *B41J 2/2114* (2013.01)

(58) Field of Classification Search
CPC ..... B41J 2/2114
See application file for complete search history.

(56) References Cited

U.S. PATENT DOCUMENTS

2005/0156964 A1 7/2005 Hoshino
2011/0032299 A1* 2/2011 Mimura ..... B41J 2/2114 347/15
2013/0300785 A1* 11/2013 Tsuchiya ..... B41J 2/21 347/7

FOREIGN PATENT DOCUMENTS

JP 2004-306557 A 11/2004
JP 2012-49719 A 3/2012

* cited by examiner

*Primary Examiner* — Alessandro Amari
*Assistant Examiner* — Roger W Pisha, II
(74) *Attorney, Agent, or Firm* — Canon U.S.A. Inc., IP Division

(57) ABSTRACT

An image forming apparatus comprising: a color ink applying unit configured to apply color ink to a print medium; a clear ink applying unit configured to apply a plurality of clear inks to the print medium to cover the applied color ink, each clear ink of the plurality of clear inks having a degree of glossiness that is different from each other; and a determining unit configured to determine an amount ratio of each clear ink to each other clear ink of the plurality of clear inks in accordance with the degree of glossiness indicated by the glossiness data and to determine an amount of each clear ink of the plurality of clear inks such that the determined ratio is satisfied and such that the clear inks cover the applied color ink and print medium at approximately 100% area coverage.

13 Claims, 15 Drawing Sheets

| | | | |
|---|---|---|---|
| 1 | 2 | 2 | 1 |
| 4 | 1 | 2 | 3 |
| 3 | 2 | 2 | 1 |
| 1 | 4 | 3 | 3 |

IMAGE FORMING APPARATUS AND IMAGE FORMING METHOD

BACKGROUND OF THE INVENTION

Field of the Invention

The present invention relates to an image forming apparatus and an image forming method.

Description of the Related Art

An ink comprising pigment is known for use in ink-let printing. However, when applied to a recording medium, the ink comprising pigment does not penetrate to the inside of the recording medium and tends to remain at the surface of the recording medium.

In an image printed from an ink comprising pigment, there are often areas of different degrees of glossiness. In other words, there will be a relatively glossy area where the glossiness is conspicuous and a relatively matte area where the glossiness is not observed within the image. This difference of degree of glossiness between areas in a printed image is recognized as "unevenness of the glossiness." The problem of unevenness of the glossiness is particularly relevant for photograph picture quality.

Some methods to solve the problem have been suggested, including providing an overcoat of colorless transparent clear ink to an image produced from an ink comprising pigment. For example, in Japanese Patent Laid-Open No. 2004-306557, a method to improve glossiness is disclosed where clear ink is provided to the non-printing area and the low duty area of the recording medium.

Furthermore, in addition to obtaining printed images with high degree of glossiness, it is desirable to control the degree of glossiness depending on a preference of the user. In other words, there is a need for an apparatus which prints an image with a desired degree of glossiness in certain portions, and relatively lesser or greater degree of glossiness in other portions by coordinating a method of applying clear ink to the recording medium. US 2005/0156964 discloses a method including printing a test pattern of a clear ink on a print medium and determining an application amount of the clear ink based on the glossiness of the printed test pattern.

In addition, Japanese Patent Laid-Open No. 2012-49719 discloses a method for reducing interference of colors when a clear ink is used by using more than two kinds of clear ink and applying a randomly set amount of clear ink to each of the pixels of a image.

However, the methods described in the above-mentioned documents do not sufficiently limit unevenness of the glossiness while allowing for control of the degree of glossiness.

FIGS. 1A and 1B are schematic views of a printed image demonstrating why known recording methods do not sufficiently limit unevenness of the glossiness and allow for controlling of the degree of glossiness.

Each divided area in FIGS. 1A and 1B represent one pixel in a printed image, including pixels 1 where only clear ink was applied, pixels 2 where only a pigmented ink was applied, pixels 3 where both the clear ink and the pigmented ink were applied, and pixels 4 where neither the clear ink nor the pigmented ink were applied. In addition, while FIGS. 1A and 1B illustrate the pixels schematically as non-overlapping rectangular shapes, it should be understood that in practice, the ink dot is generally in the shape of a circle, and adjacent ink dots may overlap.

In US 2005/0156964, the glossiness is controlled with one kind of clear ink. As shown in FIG. 1A, when clear ink was applied to the pixels 1 where a pigmented ink was applied and also applied to pixels 3 where the pigmented ink was not applied, the surface of the printed matter is completely covered by the clear ink. As a result, generally comparatively uniform glossiness is provided. However, the degree of surface glossiness of the printed matter barely changes even if additional clear ink is applied thereon. On the other hand, decreasing the amount of clear ink causes a decrease in coverage by the clear ink such that the pigmented ink and the print medium are exposed as shown by pixels 2, 4 in FIG. 1B. Because the degree of glossiness is different among clear inks, pigmented inks, and recording mediums, unevenness of degree of glossiness occurs in the printed matter. In other words, the limiting of the unevenness of the glossiness together with the ability to control of the degree of glossiness was not sufficiently achieved by the US 2005/0156964.

In addition, Japanese Patent Laid-Open No. 2012-49719 discloses a method for reducing interference of colors when a clear ink is used by using more than two kinds of clear ink and applying the clear inks to each of a plurality of pixels with a randomly set amount of the clear inks for each of the pixels. But, Japanese Patent Laid-Open No. 2012-49719 does not disclose control of the degree of glossiness as a user desires.

SUMMARY OF THE INVENTION

The advantage of some aspects of the invention is to reduce unevenness of the glossiness on the printed matter and allowing adjustment of the glossiness of the printed matter.

Aspects of the present invention include an image forming apparatus comprising: a color ink applying unit configured to apply color ink to a print medium; a clear ink applying unit configured to apply a plurality of clear inks to the print medium to cover the applied color ink, each clear ink of the plurality of clear inks having a degree of glossiness that is different from each other; a glossiness data storage unit configured to store glossiness data of degree of glossiness of an image to be formed on the print medium; and a determining unit configured to: determine an amount ratio of each clear ink to each other clear ink of the plurality of clear inks in accordance with the degree of glossiness indicated by the glossiness data stored in the glossiness data storage unit, and determine an amount of each clear ink of the plurality of clear inks such that the determined ratio is satisfied and such that the plurality of clear inks cover the applied color ink and print medium at approximately 100% area coverage.

Aspects of the present invention include an image forming method comprising: applying color ink to a print medium; applying a plurality of clear inks to the print medium to cover the applied color ink, each clear ink of the plurality of clear inks having a degree of glossiness that is different from each other; storing glossiness data on degree of glossiness of an image to be formed on the print medium; determining an amount ratio of each clear ink to each other clear ink of the plurality of clear inks in accordance with the degree of glossiness indicated by the glossiness data; and determining an amount of each clear ink of the plurality of clear inks such that the determined ratio is satisfied and such that the clear inks cover the applied color ink and print medium at approximately 100% area coverage.

Further features of the present invention will become apparent from the following description of exemplary embodiments with reference to the attached drawings.

DESCRIPTION OF THE EMBODIMENTS

Figure 1A:
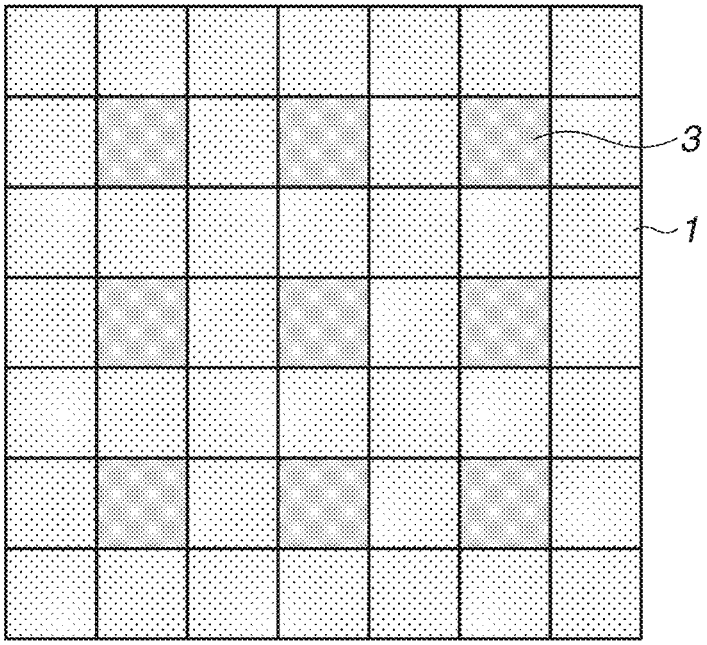
FIGS. 1A and 1B are schematic diagrams illustrating clear inks on a print medium.
Figure 1B:
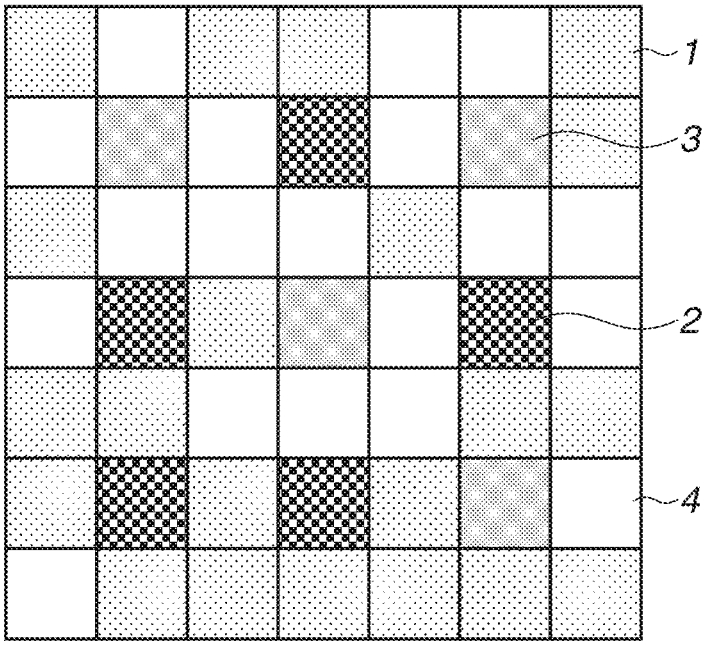

As used "herein, area coverage" means the ratio of the area of the recording medium that is covered by clear ink per unit area of the recording medium. In addition, as used herein "100% area coverage," means all pixels of the unit area are coated with clear ink as shown in FIG. 1A for example. In practice, a gap may appear between dots of the clear inks depending on the print resolution and quantity of discharge droplet. But, in a case where the gap between dots is smaller than the diameter of each of the dots and the maximum number of possible dots are formed in the unit area, the "area coverage"is considered to be "approximately 100%." Thus, as used herein, "approximately 100% area coverage" includes the condition where such an acceptable gap is present.

In addition, as used herein, "the degree of glossiness" means the degree of glossiness on the printed matter or at the surface of the recording medium. The degree of glossiness can be determined based on "specular glossiness" which is determined from the intensity of reflection of an incident light on the image. The degree of glossiness may also be determined based on the clarity of the image. Therefore, as used herein, decreasing the degree of glossiness means decreasing the specular glossiness (i.e., the intensity of reflected incident light) and/or decreasing the clarity of the image. Either the specular glossiness or the clarity may be used to express the degree of glossiness, or both of the specular glossiness or the clarity may be used.

In an example aspect, the specular glossiness is a value determined from the specular gloss examination procedure described in Japanese Industrial Standards (Z8741).

More specifically, serving as a reference point, a standard glass surface with a refractive index of 1.567, the specular reflectivity of which is 10% when visible light is incident at 60 degrees for the normal line of the standard glass surface, is considered to have a specular glossiness of 100. The specular glossiness of a target is calculated by comparing the refractive index of the target with the standard glass surface. The "clarity" of the image may be determined as a value based on the the Japanese Industrial Standards (H8686-2) using an optical device. In particular, a value C of the clarity of the image is calculated by formula: $C=(M-m)/(M+m)\times 100$, wherein M is the highest wave pattern and in is the lowest wave pattern of light quantity obtained through a optics comb when the optics comb is moved (four optics combs are used in the standard where the ratio of shade to light of each optics comb is 1:1, and width of the our optics combs are 0.125, 0.5, 1.0 and 2.0 mm, respectively).

Both of the specular glossiness and the clarity of the image are generally used for evaluation of the degree of glossiness. Specular glossiness of a surface is a measure of intensity of reflection of light from the surface, while the clarity of the image is a measure of how clear the represented image is The amount of the clear ink correlates with the specular glossiness or the clarity of the printed matter measured by the above mentioned method.

An image forming apparatus 200 of a first embodiment is explained in below.

<System Configuration>

Figure 2:
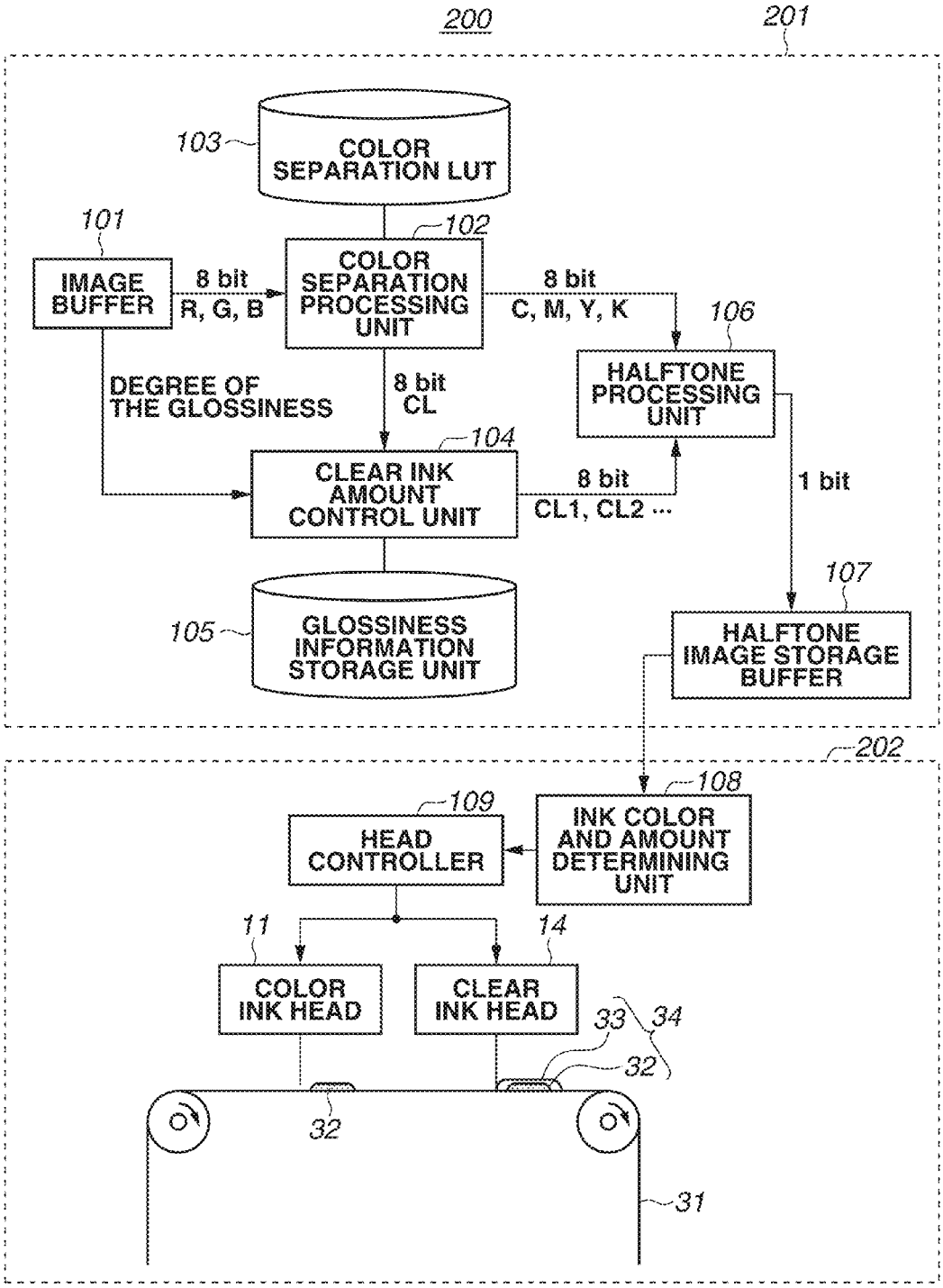
FIG. 2 is a schematic diagram of an image forming apparatus in a first embodiment.

FIG. 2 shows a schematic diagram of the image forming apparatus 200 comprising an image processing apparatus 201 and an ink-jet printing apparatus 202. In addition, for example, in another configuration, the ink-let printing apparatus 202 may comprise the image processing apparatus 201. For example, the image processing apparatus 201 may be a personal computer that reads and executes computer executable instructions (e.g., one or more programs) recorded on a storage medium (which may also be referred herein as a "non-transitory computer-readable storage medium") to perform the functions of each of the functional units of one or more of the above-described embodiment(s).The computer may include one or more circuits (e.g., application specific integrated circuit (ASIC)) for performing the functions of one or more of the above-described embodiment(s). The computer of the system/apparatus may perform a method including, for example, reading and executing the computer executable instructions from the storage medium to perform the functions of one or more of the above-described embodiment (s) and/or controlling the one or more circuits to perform the functions of one or more of the above-described embodiment (s) The computer may comprise one or more processors (e.g., central processing unit (CPU), micro processing unit (MPU)) and may include a network of separate computers or separate processors to read and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Each function of the image processing apparatus 201 described as follows is achieved by a computer carrying out a predetermined program. Ink-jet printing apparatus 202 is connected to image processing apparatus 201 by a circuit or device interface. The image processing apparatus 201 is provided with an image buffer 101, color separation processing unit 102, color separation look-up table (referred herein as a color separation LUT) 103, clear ink amount control unit 104, glossiness information storage unit 105, half tone processing unit 106 and half tone image storage buffer 107. On the other hand, the ink-let printing apparatus 202 is provided with ink color and election amount determining unit 108 and a head controller 109 which controls a color ink head 11 for ejecting color ink and a clear ink head for ejecting clear ink. The ink-jet printing apparatus 202 forms printed matter 34 by ejecting the color ink to a print medium 31 from the color ink head 11 to form a color ink image 32 and then ejecting the clear ink from the clear ink head 14 to the print medium 31 so as to cover the ink image 32.

<Image Forming Apparatus>

An image forming process executed by the image processing apparatus 201 is explained below with reference to FIG. 2 and FIG. 3.

Figure 3:
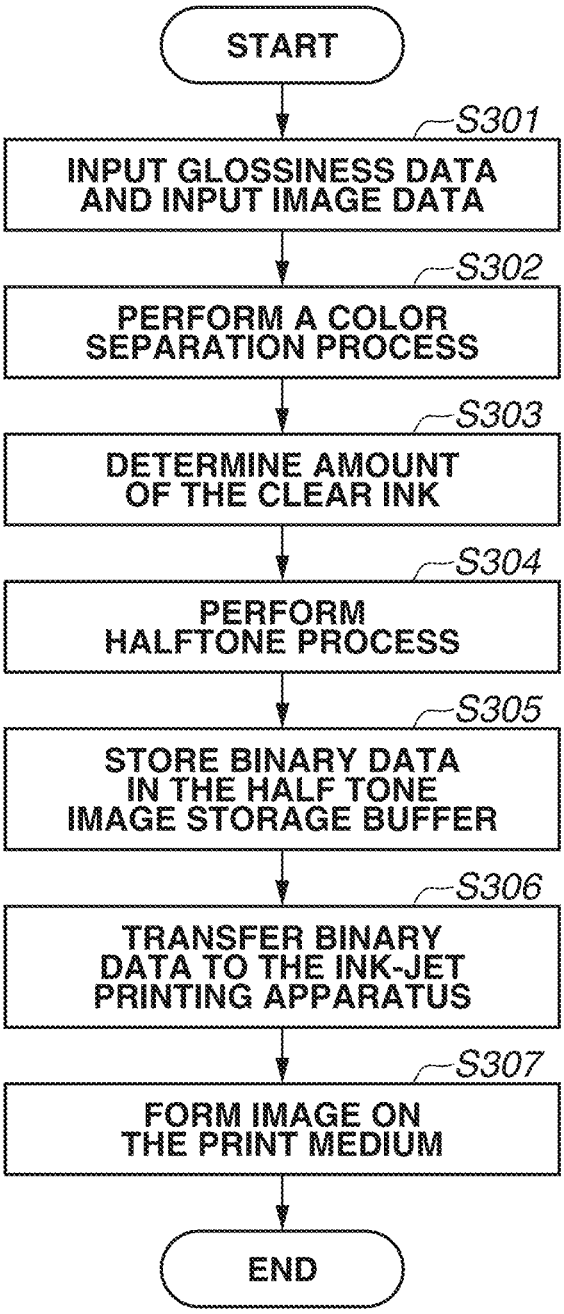
FIG. 3 is a flow chart of an image forming process in a first embodiment.

At first, in step S301 shown in FIG. 3, loses data and input image data having multi gradation levels are input into the image processing apparatus 201 via an input terminal (not shown), and the data is stored in the image buffer 101. The image buffer 101 stores the input glossiness data which indicates the degree of glossiness to be applied to an image formed by ink. The glossiness data is stored for each of he pixels of the image. The input image data includes, for example, color components of red (R), green (G), and blue (B) as color information. The image forming apparatus 201 may print a chart including test patterns formed by clear ink which show different degrees of glossiness relative to each other. One of the test patterns is selected and monitored by a user. The glossiness data corresponding to the selected test pattern may be determined so that it may be used as part of the process of forming the printed matter. A degree of the desired glossiness is input by the use to the image forming apparatus 201 by FIG. 2, where a letter of the alphabet corresponds to a degree of glossiness. In addition, the degree of glossiness can be the same for the entire printed matter, or can be determined for each region on the printed matter. For example certain objects within an overall image can be made more or less glossy. The glossiness data for each respective pixel of the image may input to the image buffer 101 with input image data.

Next, in step S302, a color separation processing unit 102 performs a color separation process to the input image data (RGB data) stored in the image buffer 101 using the color separation LUT 103. Thus the input RGB data are converted into ink amount data representing an amount of the ink (color and clear) to be applied. The ink amount data may be 6 bit data of 0 to 255, 16 bit or other bit.

The color separation processing in this embodiment will now be explained. Output ink amount data may be obtained for four color inks, cyan, magenta, yellow, and black, using LUTs for each of the colors respectively. However, color separation LUT 103 defines the ink amount for the color inks, and also the clear ink, corresponding to RGB data. Color inks defined by the color separation LUT 103 may includes light ink, for example light cyan ink, light magenta ink, or gray ink, and particular inks, for example red or green. A color separation LUT 103 defining an amount of clear ink may be prepared for each of the plural clear inks described below in accordance with the RGB data (ea, a separate table may be prepared for each clear ink) or a single color separation LUT may define the amounts all of the clear inks of the plural clear inks in accordance with the RGB data (e.g., only one table). Here a pixel position in the image of RGB data is expressed as a coordinate (i, j). Conversion from RGB data in the coordinate (i, j): R (i, j), G (i, j), B (i, j) to ink amount data C (i, j), M (i, j), Y (i, j), K (i, j), CL (clear) (i, j) is expressed in formula (1).

$$C(i, j)=C_LUT_3D(R(i, j), G(i, j), B(i, j)),$$

$$M(i, j)=M_LUT_3D(R(i, j), G(i, j), B(i, j))$$

$$Y(i, j)=Y_LUT_3D(R(i, j), G(i, j), B(i, j)),$$

$$K(i, j)=K_LUT_3D(R(i, j), G(i, j), B(i, j))$$

$$CL(i, j)=CL_LUT_3D(R(i, j), G(i, j), B(i, j)). \quad \text{Formula (1)}$$

Each function defined in the right side of formula (1) corresponds to color separation LUT 103. Output value for five colors, such as C, M, Y, K, CL are obtained by the color separation LUT 103 based on values of the input RGB data. The amount of the clear ink for a unit area is defined in the color separation LUT 103 in a manner such that the amount of clear ink provides 100% area coverage. Such amount is determined in accordance with the resolution of the image to be printed and the dot diameter of the clear ink or based on a prior comparative test print.

Next, in step S303, the clear ink amount control unit 104 determines an application amount of the clear ink in accordance with the ink amount data for CL. In this embodiment, glossiness information of each of the plural clear inks stored in the glossiness information storage unit 105 is referenced, amounts of the plural clear inks (CL1, CL2 . . . ) corresponding to the input degree of glossiness are determined while satisfying the amount indicated by the ink amount data for CL, and then, the determined amounts of the plural clear inks (CL1, CL2 . . . ) are output to the halftone processing unit 106.

Next, in step S304, the halftone processing unit 106 performs halftone process to the obtained ink amount data (color and clear) by the color separation processing unit 102 and the clear ink amount control unit 104. Thus, each of the ink amount data expressed by multi-value of 8 bit is converted to binary data indicating on or off on dot or forming respectively. In step S305, the obtained binary data is stored in the half tone image storage buffer 107. A halftone method used in the process by the halftone processing unit 106 may be an error diffusion method or a binarization using the dither matrix. A process for making the binary data have a complementary relationship or a correlation relationship may be adopted in the halftone process.

In step S306, the binary data stored in the half tone image storage buffer 107 is transferred to the ink-let printing apparatus 202 at a size, for example, of the whole image or a predetermined size. Next, in step S307, the image is formed on the print medium according to the binary data of the color inks and clear inks by the ink-jet printing apparatus 202.

An image formation process is performed as described above. According to the image formation process, the image formed by color ink is covered with clear ink with 100% area coverage while also having the degree of glossiness input by the user.

Figure 4:
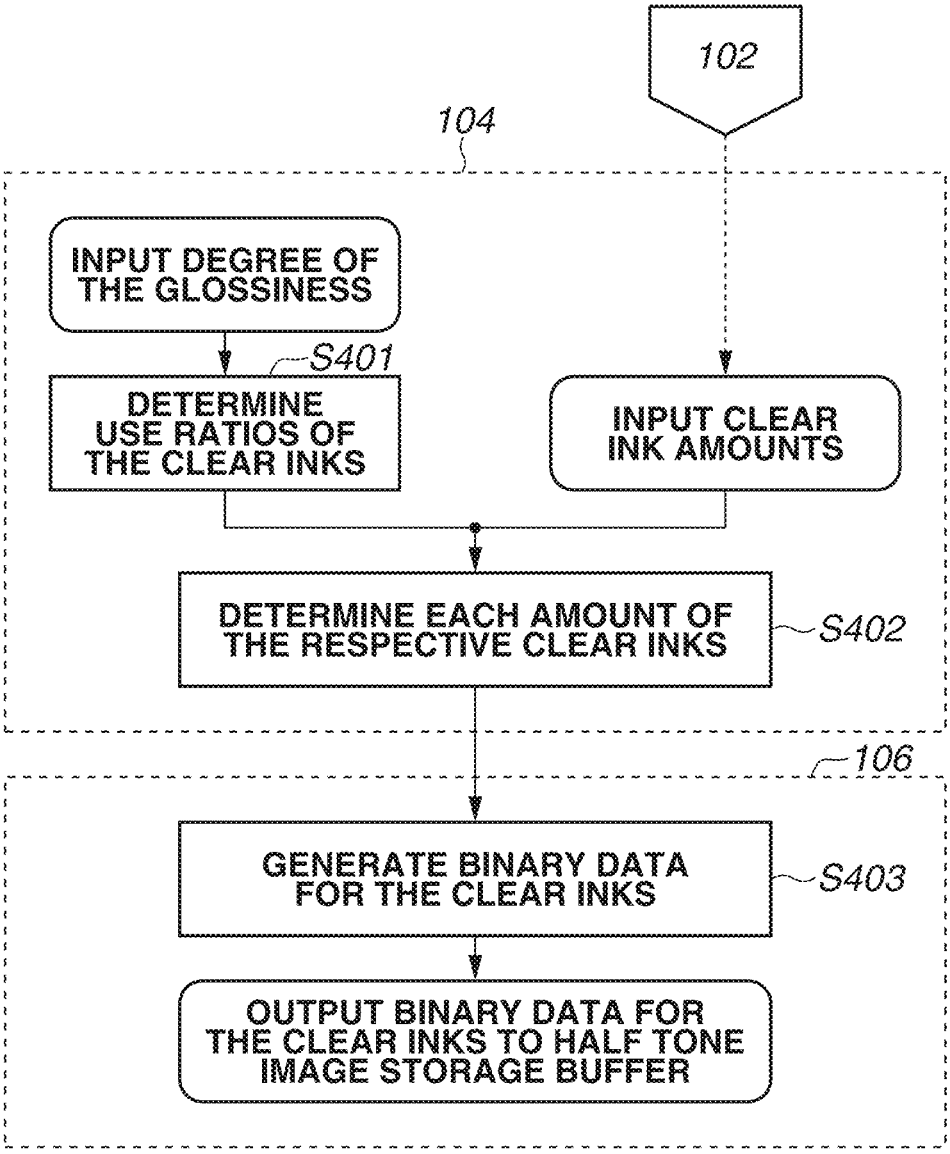
FIG. 4 is a flow chart of an image forming process in a first embodiment.

Additional details of step S303, for determining the application amount of the clear ink, are described below with respect to the clear ink amount control unit 104. In FIG. 4, step S401 is a process for determining use ratios of plural clear inks. In this process, information of the use ratios is read from the glossiness information storage unit 105 corresponding to the degree of glossiness input by user and set print condition. Step S402 is a process for determining each amount of the respective plural clear ink (CL1, CL2 . . . ). The amounts are calculated using the clear ink amount indicated by the ink amount data for CL obtained by the color separation processing unit 102 and the use ratio of plural clear inks obtained in the step S401. In the step S403, the halftone processing unit 106 generates binary data for the clear inks so as to reduce overlapping of dots of the clear ink or different clear inks to make a thickness of a layer of the clear inks even. If different degrees of the glossiness are input for different areas of the printed matter to be formed or different objects of the image, the above-described determination of the application amount of the clear ink is performed for each of the different areas or different objects. The clear ink amount control unit 104 also judges difference of the degree of glossiness caused by amounts of the color ink in a particular area of the printed matter. If the difference of the degree of glossiness is higher than a threshold, the clear ink amount control unit 104 divides the particular area into sub areas and generates binary data for the clear inks according to the flow in FIG. 4. Then, the binary data for the clear inks are output to the halftone image storage buffer 107.

<Ink-Jet Printing Apparatus>

In FIG. 2, in the ink color and amount determining unit 108, an application amount for each ink is determined. Information on the determined application amounts is sent to the head controller 109. When the print medium 31 arrives at position opposite to the color ink head 11, each of the color inks are ejected from the color ink head 11 to form color ink image 32 on the print medium 31. Furthermore, the clear ink 33 is applied on the formed color ink image 32 to form the printed matter 34. In FIG. 2 the color ink head 11 and the clear ink head 14 are separately disposed and the clear ink head 14 is arranged downstream of the color ink head 11 in a direction of the movement direction of the print medium 31. However, it is not limited to this arrangement, the color ink head 11 and the clear ink head 14 may be formed as one body. Any constitution is available such that the clear ink forms a top surface of the printed matter 34.

Figure 5:
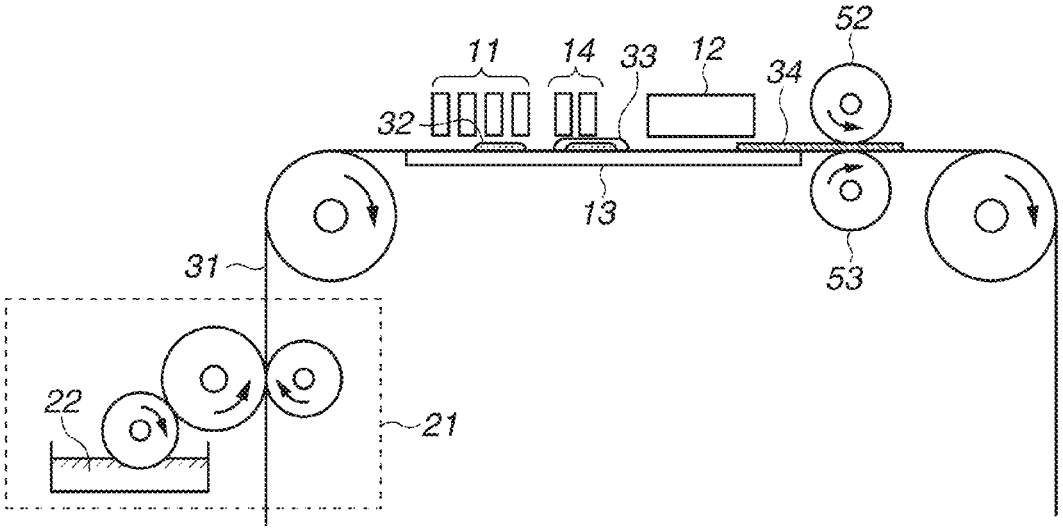
FIG. 5 is a schematic diagram of an image forming apparatus in a first embodiment.

FIG. 5 shows the ink-jet printing apparatus and printing process of this embodiment.

In FIG. 5, a treatment liquid 22 is applied to the print medium 31 by a roller type application machine 21. Next, color ink head 11 (four heads for CMYK) eject inks to the print medium 31 to form color ink image 32, and the clear ink head 14 ejects the clear ink on the color ink image 32 to form the printed matter 34. Next, the liquid content of the printed matter 34 is reduced by air drying from the air flow device 12. Lastly, the printed matter 34 is heated and pressed by the press roller 52 to be fixed to the print medium 31. In FIG. 5, opposite roller 53 is arranged so as to oppose the press roller 52 with a predetermined nip interval. Support member 13, such as a platen, may include a heating mechanism to heat the print medium 31 and promote drying of the printed matter 34. When printing is stared, the treatment liquid 22, which can chemically react with the color ink or be absorbed into the color ink, is applied to the print medium 31 to increase a viscosity of the color ink. In this embodiment, paper, cloth, plastic, film, and other materials may be used as the print medium 31.

<Treatment Liquid>

The treatment liquid 22 may coagulate the color ink. Additionally, the treatment liquid can limit bleeding phenomenon of the color inks. The treatment liquid 22 may comprise, for example, a polyvalence metal ion and/or some organic acids etc, as a compound for increasing the viscosity of the color ink. It is preferred that the compound for increasing the viscosity of the color ink is included at more than 5 percent weight of the treatment liquid.

Examples of the compound for increasing the viscosity of the color ink are bivalence metal ions such as $Zn^{2+}$, $Ca^{2+}$, $Cu^{2+}$, $Mg^{2+}$, or trivalence metal ions such as $Fe^{3+}$, $Cr^{3+}$, etc.

Examples of the compound for increasing the viscosity of the color ink are organic acids such as oxalic acid, polyacrylic acid, acetic acid, malic acid, etc.

The treatment liquid 22 may comprise water-soluble organic solvent or resin as added matter to make the printed matter solid. Furthermore, the treatment liquid may include a surfactant such as "Acetylenol E100" (Product name, Kawaken Fine Chemical, Ltd.) or a material for adjusting its viscosity.

<Application of the Treatment Liquid>

Several methods for applying the treatment liquid 22 to the print medium 31 may be used, for example die coating, blade coating, or roller coating (FIG. 5). An ink jet method is an option for applying the treatment liquid 22 to the print medium 31.

<Application of the Color Ink>

In this embodiment, the color ink head 11 is used for applying the color inks to the print medium 31. A plurality of separated color ink heads or one body head that ejects a plurality of different color inks may be used as the color ink head 11.

<Ink Jet Print Head>

In this embodiment, an ink jet head that ejects ink using bubble caused by electro-thermal transducer may be used as the color ink head 11. Also, an ink jet head that ejects ink using electro-mechanical transducer may be used. Printing may be performed by ink ejection while the color ink head 11 moves in cross direction crossing the feed direction of the print medium 31. A line-type inkjet head having ink ejection nozzle arranged in cross direction crossing the feed direction of the print medium 31 is also an option.

<Color Ink>

The color ink in this embodiment is explained in below.

The color ink comprises pigment as a coloring material. The pigment is not particularly limited. Pigments corresponding to the color inks are used. Carbon black is preferred for black ink. The amount of pigment in the color ink may be 0.5 weight percent to 15.0 weight percent, more preferably 1.0 weight percent to 10.0 weight percent.

The color ink in this embodiment comprises a dispersing agent for dispersing the pigment. A dispersing agent having a hydrophilic group and a hydrophobic group is preferably used. In particular, copolymer obtained by copolymerizing hydrophilic monomer and hydrophobic monomer is preferably used as the dispersing agent. For example, styrene, its derivative, alkyl(meth)-acrylate is may be used as the hydrophobic monomer, and acrylic acid, methacrylic acid, etc may be used as the hydrophilic monomer. In addition, a self-dispersion pigment ink that is configured disperse itself may be used.

<Resin Particle>

The color ink in this embodiment also comprises resin particles which improve image quality and fixing characteristic of the color ink image 32 to the print medium 31, for example, a polymer such as polyolefine, polystyrene, or a copolymer thereof. The weight average molecular weight of the polymer may be 1000 to 2000000. The amount of the polymer in the color ink may be 2 to 40 wt % of the total weight of the ink. Additionally, it is preferred that the resin particles are dispersed in a liquid with emulsifying agent as a surfactant.

<Surfactant>

The color ink in this embodiment may comprise a surfactant other than the surfactant used for dispersing the resin particle. For example, "Acetylenol E100" (Product name, Kawaken Fine Chemical, Ltd.) may be used.

<Water and Water-Soluble Organic Solvent>

The color ink in this embodiment comprises may comprise water and water-soluble organic solvents. For example, glycerin, and 2-pyrolidone may be used as the water-soluble organic solvent. Another additive, such as a pH moderating agent may be used if necessary.

<Application of the Clear Ink>

A plurality of the clear inks is applied to the print medium 31 by the clear ink head 14. To provide a specific amount of the clear ink to a particular area of the print medium 31 (e.g., where different areas are to have different amounts of clear ink relative to other areas), a gravure roller can be used for applying the clear ink to the print print medium 31.

<Clear Ink>

Clear inks in this embodiment are substantially colorless and transparent, and do not substantially contain color materials. Clear inks may comprise a water soluble resin, a colorless resin particle, a surfactant, a water and water-soluble organic solvent as explained above. The weight percentage of the water soluble resin, or the colorless resin particle, is preferably 1 to 10 based on the total weight of the clear ink. The weight percentage of the surfactant is preferably 0.01 to 5 based on the total weight of the clear ink. The amount of water in the clear ink is preferably 30 to 90 weight percent based on the total weight of the clear ink, and the amount of water soluble organic solvent is preferably 3 to 50 based on the total weight of the clear ink. The degree of glossiness varies depending on the components of the clear ink. More specifically, the refraction index of the components, the diameter of the resin particles or degree of shape changing of the resin particles is impacted by the glass transition point of the resin particle. Thus, two different types of clear ink is prepared and a ratio of a first clear ink to a second clear ink is chanced during use so as to provide a range of glossiness, from the highest degree of glossiness to the lowest degree of glossiness.

<Reducing Liquid from the Printed Matter 34>

Liquid contained in the printed matter 34 is reduced by the air flow device 12. However, decompression or absorbing by the absorber is also available for reducing liquid from the printed matter 34.

<Fixation of the Printed Matter 34>

Figure 6:
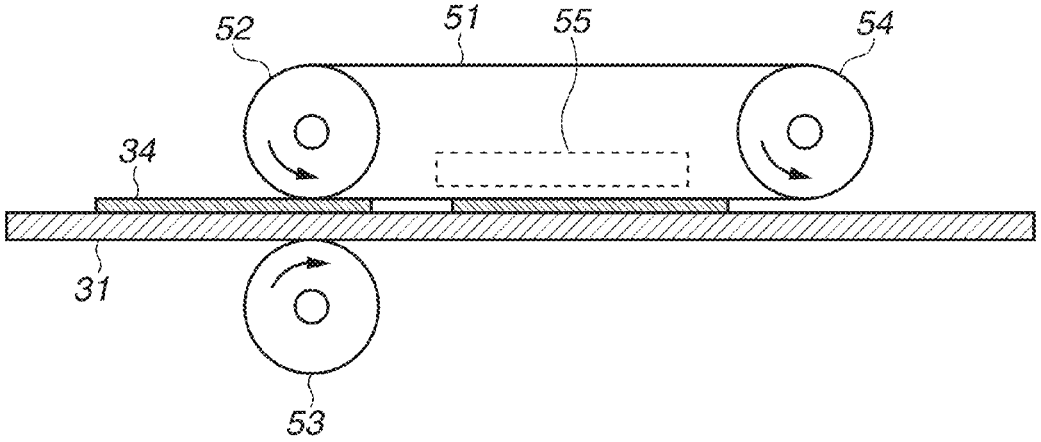
FIG. 6 is schematic diagram of a cooling detachment mechanism in a first embodiment.

In this embodiment, after reducing the liquid from the printed matter 34, fixation of the printed matter 34 to the print medium 31 is performed. The clear inks at the surface of the printed matter 34 are heated, and transformed. In particular, it is preferred that a sheet having highly flat surface is laminated on the printed matter 34 and then the fixation is performed. The sheet may be formed of metal resin or rubber. A cooling detachment mechanism as shown in FIG. 6 can be used. Cooling mechanism 55 cools the printed matter 34 heated with fixing belt 51 by the press roller 52 and the opposite roller 53. Cooled printed matter 34 is separated from the fixing belt 51. The cooling detachment mechanism prevents a portion of the printed matter 34 from remaining on the fixing belt 51.

Figure 7A:
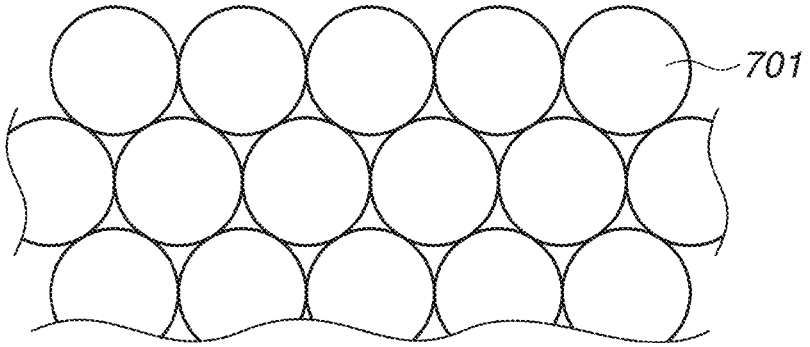
FIGS. 7A to 7C are schematic diagrams of the surface of applied clear ink.
Figure 7B:
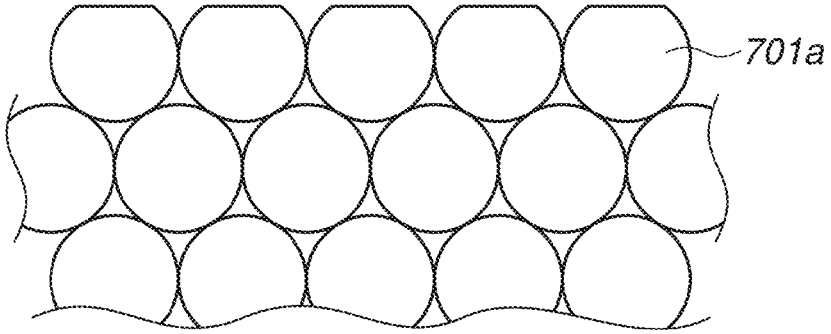
Figure 7C:
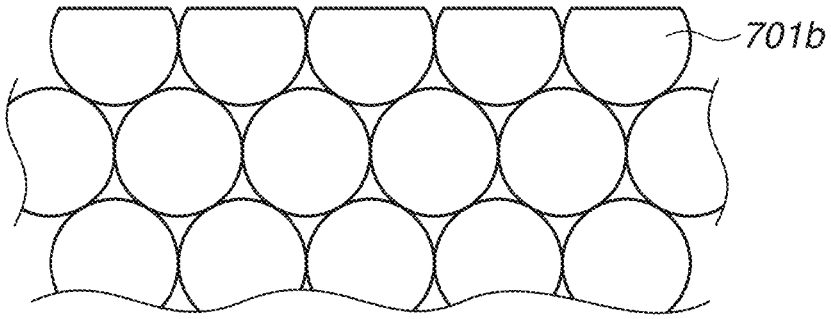

FIG. 7A shows a surface of a clear ink containing resin particles 701 as applied on the print medium. Before fixation, the resin particles 701 are exposed and the surface is uneven. FIG. 7B shows a surface of a fixed clear ink containing resin particles 701*a* having a relatively high glass transition point. In FIG. 7B, the surface remains uneven because the resin particles 701*a* are too hard to be transformed, even if heated. On the other hand, FIG. 7C shows a surface of a fixed clear ink containing resin particles 701*b* having a relatively lower glass transition point than that of the resin particles 701*a*. In FIG. 7C, the surface is flat because the resin particles 701*b* are easily transformed by heating and pressing.

Thus, the flatness of a surface of the fixed clear ink is changed depending on the glass transition point or diameter of the resin particles when the other fixed condition is not changed. By using these characteristics it is possible to change the degree of glossiness in a printed matter.

For example, the heat temperature by the fixing unit can be fixed over the maximum transition point of the resin in the clear inks, and the heat time is controlled such that the temperature of the clear inks do not reach the maximum transition point of the resin. Because the clear inks are fixed while the resin retains its shape, the flatness of the surface of the clear inks is controlled and the degree of the glossiness is also controlled. As described above, the fixing condition for the clear inks is determined according to characteristics of the clear inks and desired degree of glossiness of the printed matter.

The second embodiment is described below.

<System Configuration>

Figure 9:
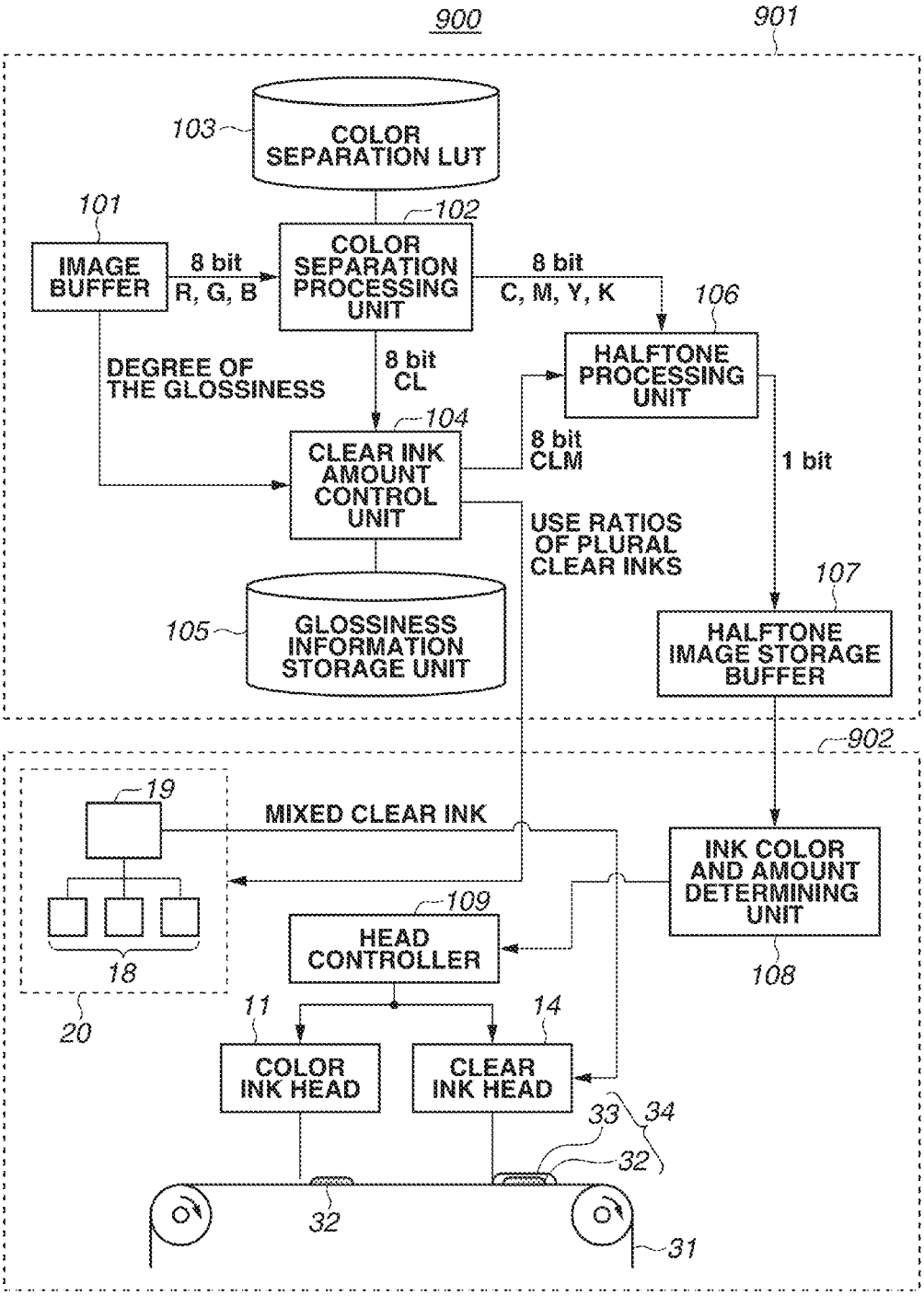
FIG. 9 is a schematic diagram of an image forming apparatus in a second embodiment.

FIG. 9 shows a schematic diagram of the image forming apparatus 900 in the second embodiment. In the second embodiment, mixed clear inks are applied to the print medium 31 from clear ink head 14 in the ink-jet printing apparatus 902. Each of the clear inks saved in a respective clear ink tank 18 is mixed by a clear ink mixing device 19 before the clear inks are sent to the clear ink head 14. The elements shown in FIG. 9 that are the same as shown in FIG. 2 have the same numerals as used above and the description of such elements are the same as described above.

In the second embodiment, in the image processing apparatus 901, glossiness data stored in the image buffer 101 is input to the clear ink amount control unit 104. Next, the ink amount control unit 104 determines use ratios (mixing ratios) of the clear inks to obtain an input degree of glossiness indicated by the glossiness data in accordance with glossiness information stored in the glossiness information storage unit 105.

The ink amount control unit 104 sends information on the determined use ratios to the clear ink mixing unit, which includes the clear ink tank 18 and the clear ink mixing device 19. Each of the clear inks is sent to the clear ink mixing device 19 from the respective ink tank 18 in accordance with the determined use ratios, and then mixed in the ink mixing device 19. Mixed clear inks are sent to the clear ink head 14.

In the second embodiment, image processing is performed as described below.

Color separation process for generating multi-valued data of five colors (C, M, Y, K, CL) is executed by the same method as the color separation process of step S302 of the first embodiment.

The halftone process for each of the generated multi-valued data is performed by the same method as in step S304.

Figure 10:
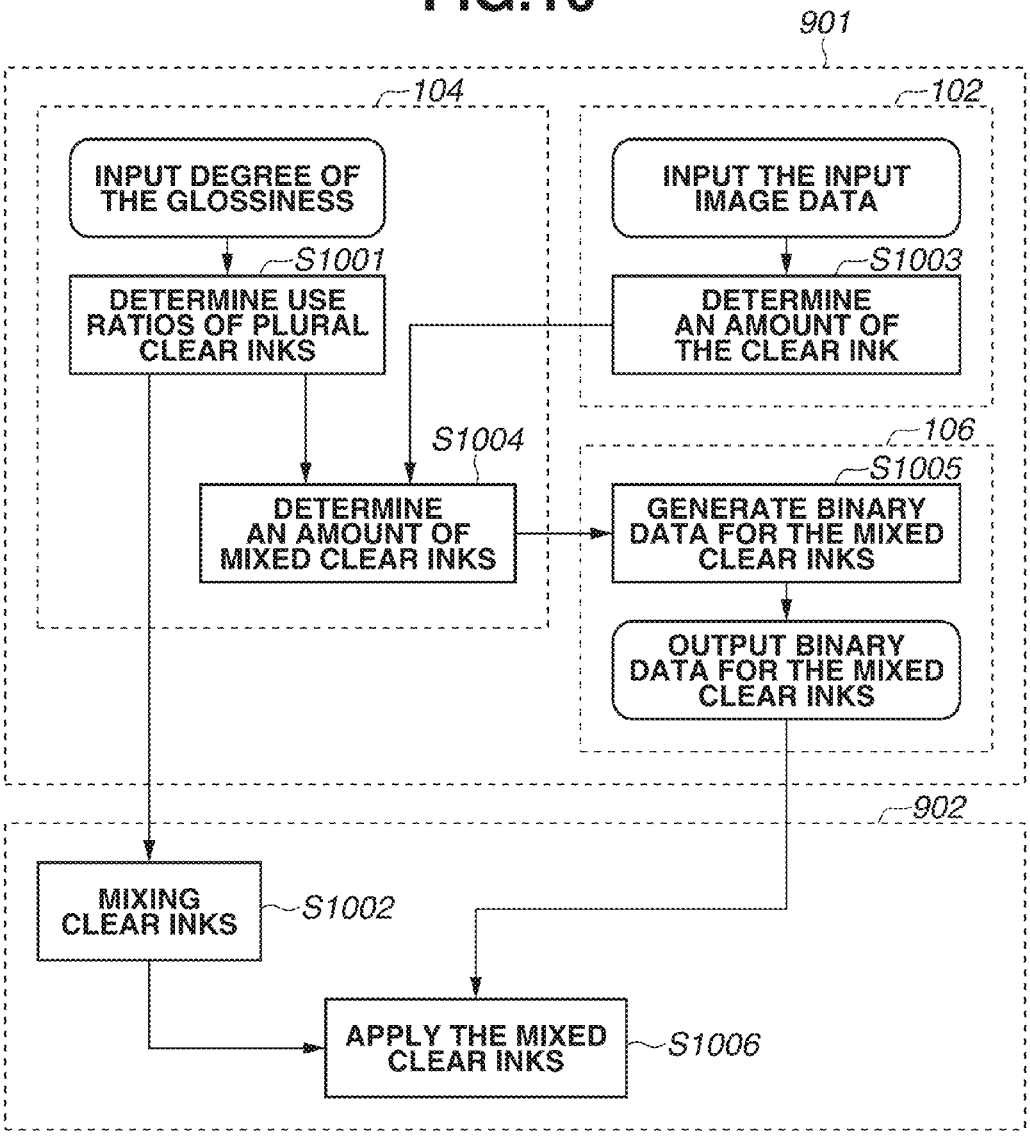
FIG. 10 is a flow chart of an image forming process in a second embodiment.

FIG. 10 shows an application method of the mixed clear inks. In step S1001, the ink amount control unit 104 determines use ratios (mixing ratios) of the clear inks by the same method as step S401 of the first embodiment. In step S1002, the ink amount control unit 104 sends information on the determined use ratios to the clear ink mixing unit, which includes the clear ink tank 18 and the clear ink mixing device 19. Then, each of the clear inks is sent to the clear ink mixing device 19 from the respective ink tank 18 according to the determined use ratios and then mixed in the ink mixing device 19. In step S1003, the color separation process for generating multi-valued data of five colors (C, M, Y, K, CL) is executed. An application amount of the clear ink (CL) is determined in a manner that achieves 100% area coverage 100% by the clear ink. In step S1004, the ink amount control unit 104 determines the application amount of the mixed clear ink (CLM) according to the use ratios (mixing ratios) determined in step S1004, and sends information on the determined application amount of the mixed clear ink (CLM) to the halftone processing unit 106.

After step S1005 and step S1006, the image processing process by the image processing apparatus 901 and image forming by the ink-jet printing 902 apparatus are performed in the same manner as the first embodiment.

The third embodiment is described below.

In the third embodiment, two kinds of clear inks are used.

Figure 12:
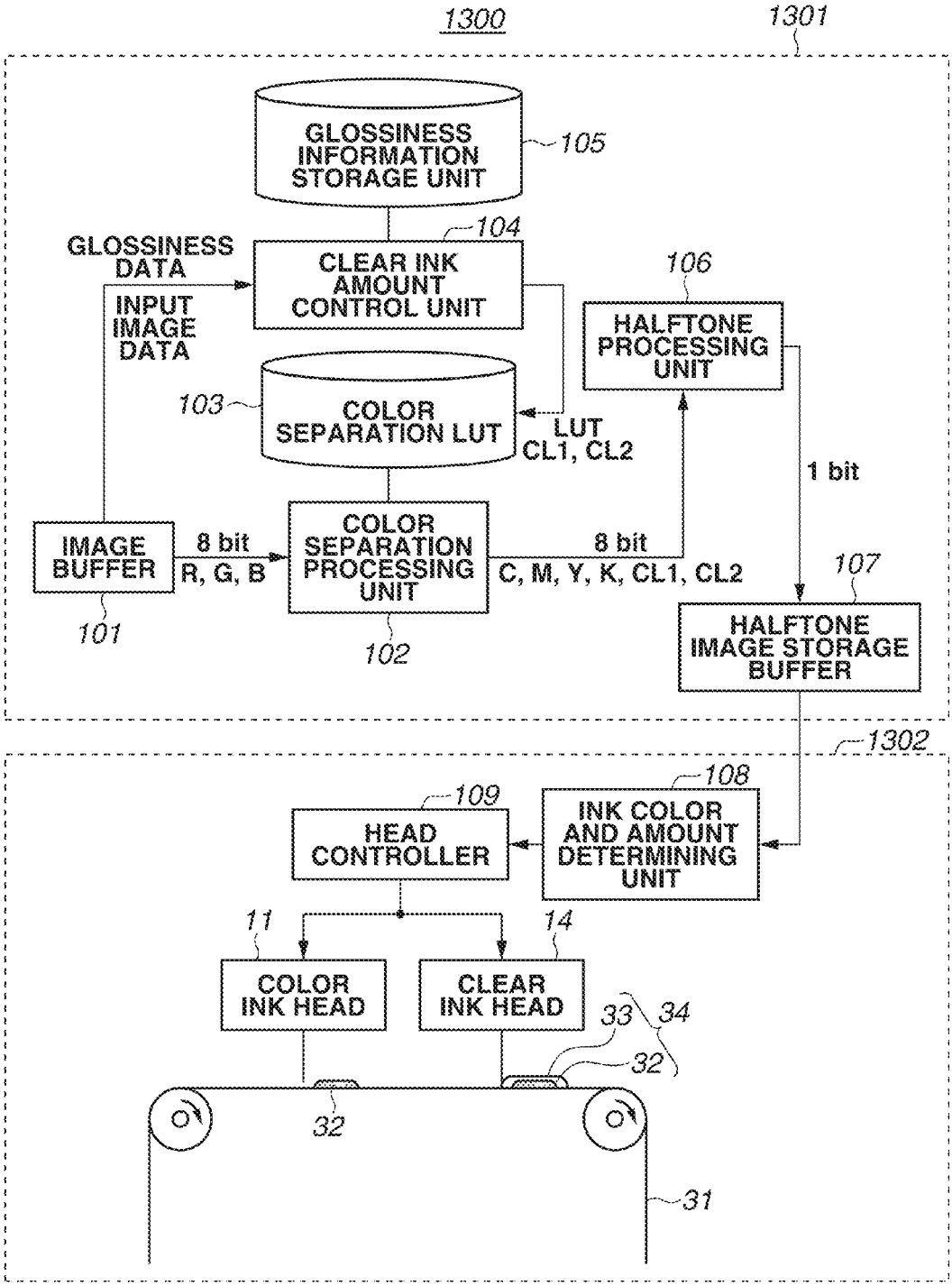
FIG. 12 is a schematic diagram of an image forming apparatus in a third embodiment.

FIG. 12 shows a schematic diagram of the image forming apparatus 1300 in this embodiment.

In the third embodiment, the clear ink amount control unit 104 generates two color separation LUTs for the two kinds of clear inks in accordance with glossiness information for the two kinds of clear inks from the glossiness information storage unit and the input image data. The generated two color separation LUTs for the two kinds of clear inks are stored in the memory. The color separation processing unit 102 uses the generated two color separation. LUTs for the respective two kinds of clear inks as the color separation look-up table 103. In this embodiment, the color separation processing unit 102 determine each amount of the two kinds of clear inks individually.

While the present invention has been described with reference to exemplary embodiments, it is understood that the invention is not limited to the disclosed exemplary embodiments.

Figure 13:
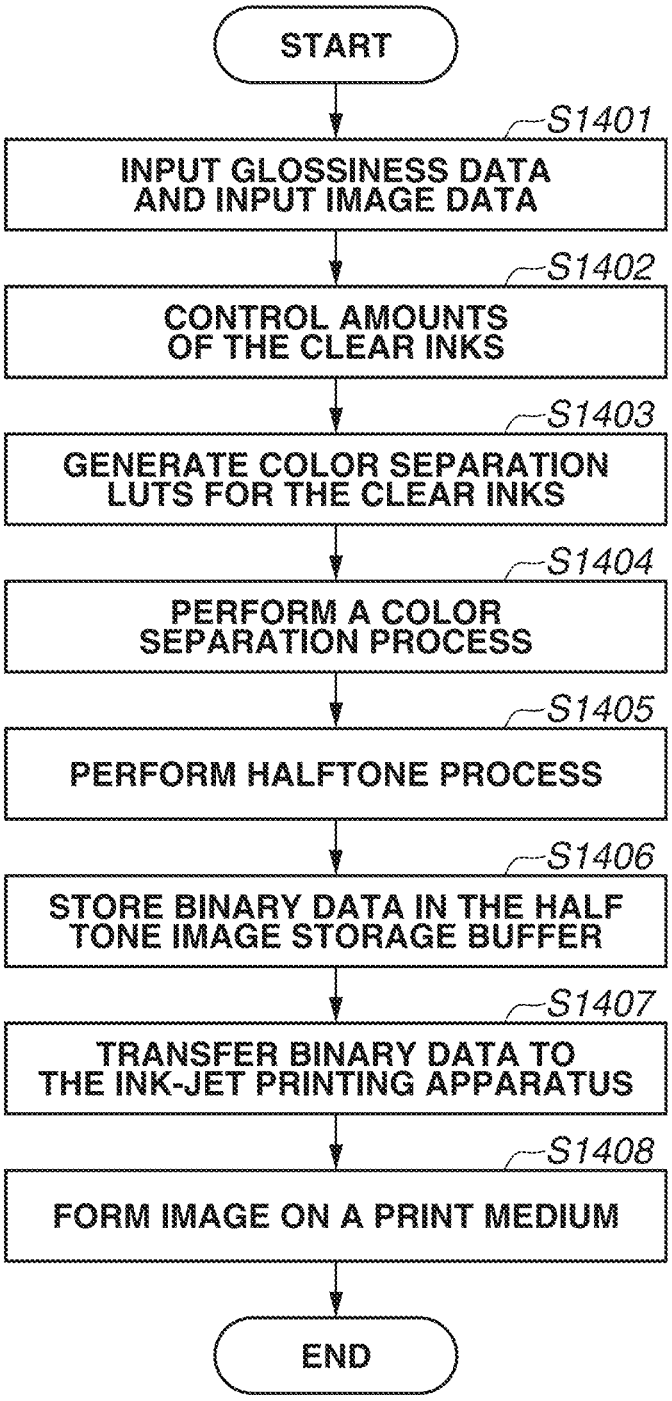
FIG. 13 is a flow chart of an image forming process in a third embodiment.

FIG. 13 shows a flowchart of an image forming process.

First, in step S1401, glossiness data and input image data having multi gradation levels are input into image processing apparatus 201 via an input terminal (not shown), and the data is stored in the image buffer 101.

Next, in step S1402, the clear ink amount control unit 104 determines application amounts of the two kinds of clear inks for each of the pixels to achieve the desired degree of classiness based on the glossiness data from the image buffer 101. Next, in step 1403, the clear ink amount control unit 104 generates two color separation LUTs according to the input image data for each of the pixels.

Next, in step S1404, the color separation processing unit 102 performs a color separation process to the input image data (RGB data) stored in the image buffer 101 using a color separation LUT 103. Thus, the input RGB data are converted into each ink amount data indicating the applying amount of the ink (color and clear). The ink amount data may be 8 bit data of 0 to 255, 16 bit or other bit.

Conversion from RGB data in the coordinate (i, j): R (i, j), G (i, j), B (i, j) to CL1 (i, j) and CL2 (i, j) is expressed in a formula shown in below:

$$CL1(i, j)=CL1_LUT_3D(R(i, j), G(i, j), B(i, j))$$

$$CL2(i, j)=CL2_LUT_3D(R(i, j), G(i, j), B(i, j))$$

The meaning of the formula is same as that of the first embodiment.

Step S1405 and the steps following thereafter are performed in same manner as described in the first embodiment.

In this embodiment, image formed by the color ink is covered with clear ink at 100% area coverage and the application amounts of the clear inks are controlled for each of the pixels, such that unevenness of the glossiness is greatly reduced. Furthermore, the user can control the degree of glossiness for each of the pixels.

Figure 14:
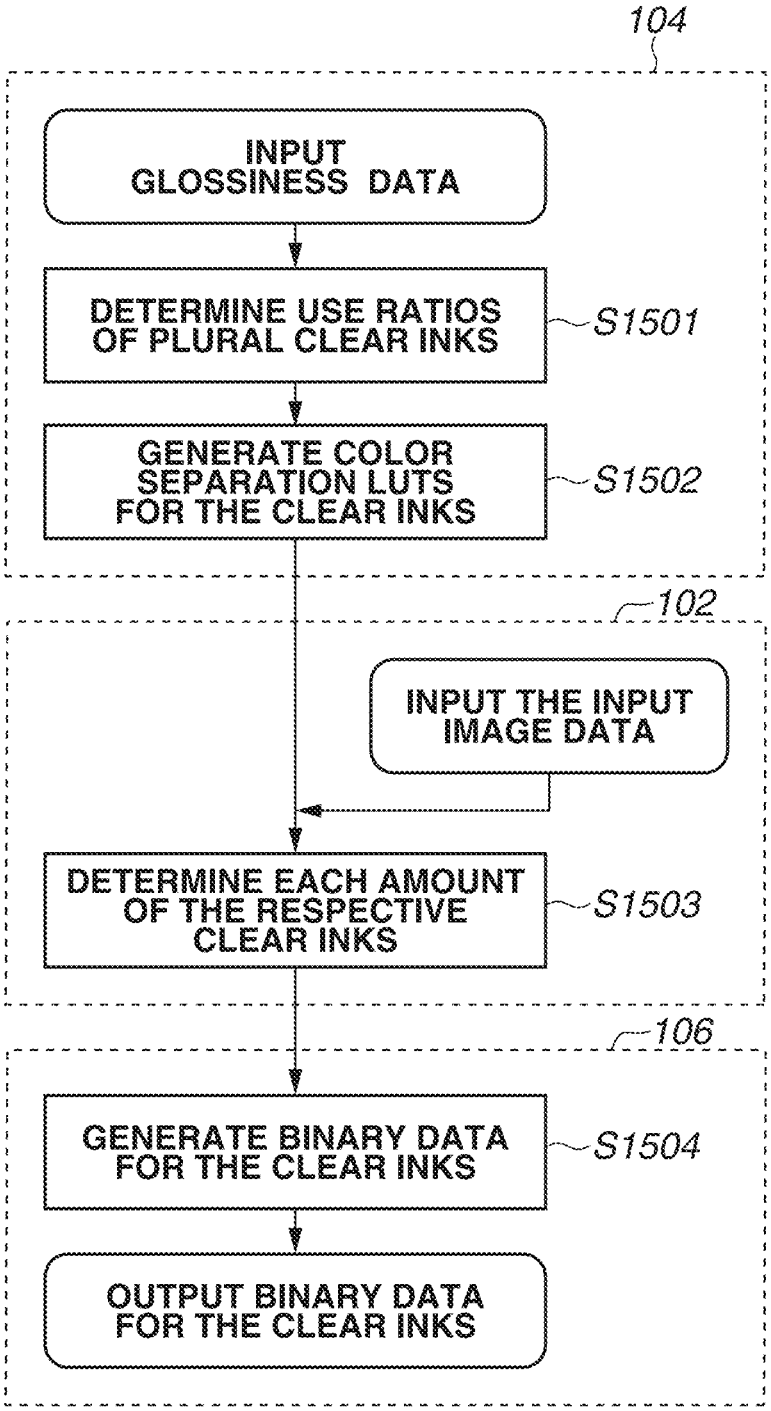
FIG. 14 is a flow chart of an image forming process in a third embodiment.

FIG. 14 shows a flowchart providing a detailed explanation of the application of clear inks.

In step S1501, the use ratios of the plural clear inks are determined. In this step, based on the input glossiness data and set printing condition, the use ratios of the plural clear inks are determined. Next, in step S1502, the two color separation LUTs for the respective two kinds of clear inks are generated based on the determined use ratios and the input image data. Next, in step S1503, the color separation processing unit 102 performs a color separation process to the input image data (RGB data). The two color separation LUTs are generated such that the image formed by the color ink is covered with clear ink at 100% area coverage.

Examples are described below. As used below, "part" and "%" represent mass units.

EXAMPLE 1

Two clear inks were prepared. The components described below were combined and mixed and then filtered by 0.3 micro meter filter (made by Fuji film ltd.).

(Composition of Clear Ink 1)

Dispersed resin particle (approximately 20% density) (diameter: approximately 100 nm, molecular weight: approximately 10000): 50 part Glycerin: 5 parts Diethylene glycol: 7 parts Surfactant (Acetylenol EH): 0.5 parts Ion exchange water: 37.5 parts (Composition of Clear Ink 2)

Styrene acrylic acid resin (about 20% density) (the acid value 150, a weight-average molecular weight 8000): 50 parts Glycerin: 5 parts Diethylene glycol: 7 parts Surfactant (Acetylenol EH): 0.5 parts Ion exchange water: 37.5 parts Next, degrees of glossiness were measured for the two prepared clear inks (clear inks 1 and 2). First, treatment liquid was applied to a print medium ("Mirror coat gold" castcoat paper made by Oji papermaking Ltd.) by the ink-jet printing apparatus 202 as shown in FIG. 2. Next, the clear ink drop was applied to the print medium entirely at 4 pl per dot in 1200 dpi by the ink-jet printing apparatus 202 as shown in FIG. 2. The print medium was covered with the clear ink at 100% area coverage. Next, the print medium was dried to remove water from the applied clear ink. The clear ink was fixed by the fixing roller using 39.2 N/cm$^2$ (4 kgf/cm$^2$) pressure at 120° C. in 150 ms. The clarity of the image of clear ink 1 was 69, and of clear ink 2 was 83, as measured by clarity measuring device ICM-1T (made by Suga measuring device Ltd.). The specular glossiness was measured by GMX-203 (made by Murakami color technology research Ltd.). The measured specular glossiness was 41 for clear ink 1, and was 84 for clear ink 2.

(Printing Image for Evaluation)

The image forming apparatus 202 as shown in FIG. 2 was used. As a print medium, "Mirror coat gold" (castcoat paper made by Oji papermaking Ltd.) was used. The ejection amount per one dot was 4 pl for both of the color and clear inks.

The color image by each of C, M, Y, K color inks were formed at a print rate of 25%, 50%, 100%, 200%, in 1200 dpi. The clear ink was applied at various rates on the formed image.

The user can select one level among four levels for the degree of the glossiness described below. If degree A was selected, only the clear ink 2 was used to form a printed matter having high glossiness. If level D was selected, only the clear ink 1 was used to form a printed matter having low glossiness. In between level A and level D, level B and level C, in which glossiness was lower than that of level D, was prepared. Both of clear ink 1 and clear ink 2 were used for levels B and C and the use ratios of clear ink 1 to clear ink 2 were different between the level B and level C.

Color separation was performed by the color separation processing unit 102. Input image data (RGB) was converted to data of amount C, M, Y, K, CL as five colors. In this example, data on the total amount of the clear inks was obtained by the color separation processing.

Then, the clear ink amount control unit 104 determined amounts of clear ink 1 and clear ink 2 according to the total amount of the clear inks. The use ratio of clear ink 1 to clear ink 2 was 6 to 10 for level B, and was 11 to 5 for level C.

Figure 8A:
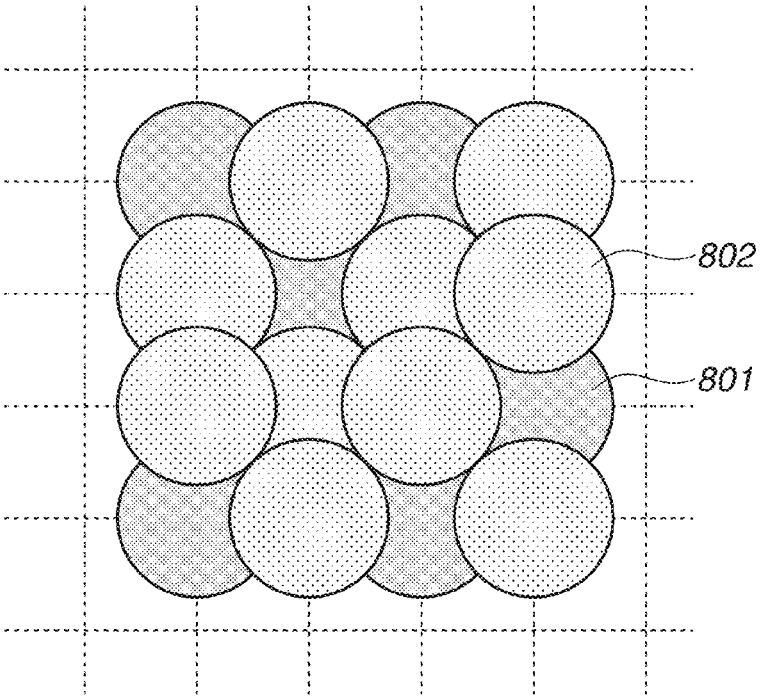
FIGS. 8A and 8B are schematic diagrams of applied clear ink on a print medium.
Figure 8B:
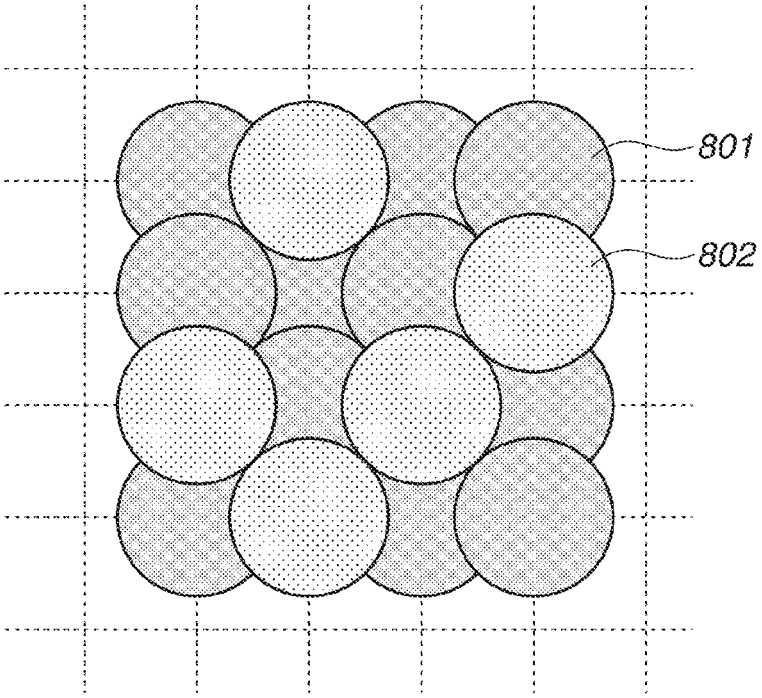

FIG. 8A shows a state of applied clear ink on the print medium about level B, and FIG. 8B shows a state of applied clear ink on the print medium about level C. Grid lines in the FIGS. 8A and 8B are additional lines to show the print resolution. In this example, one droplet of the color ink and one droplet of the clear ink were applied to each inter unit of the grid lines. FIGS. 8A and 8B show clear ink 1 801 (lower specular glossiness) and a clear ink 2 802 (higher specular glossiness). And in this example, applied amounts of the color inks for the respective matrixes formed by 4 pixels length and 4 pixels width are the same.

In FIG. 8A, six dots of clear ink 1 801 and ten dots of clear ink 2 802 are formed. 100% area coverage is achieved by clear ink 1 and clear ink 2. Clear ink 1 was applied to the formed image prior to clear ink 2. Since clear ink 2 covered clear ink 1 in overlapping points of the two clear inks, an area ratio on a surface of the printed matter was smaller than the use ratio. The area ratio of the clear ink 2 for level B was higher than that of level C, so that a degree of glossiness of the printed matter for level B was higher than that for the level C.

On the other hand, in FIG. 8B, eleven dots of clear ink 1 801 and five dots of clear ink 2 802 were formed. 100% area coverage was achieved by clear ink 1 and clear ink 2.

Still, in gaining dot arrangements of clear ink 1 and clear ink 2 shown in FIGS. 8A and 8B, the halftone processing unit 106 processed data such that the dots were not unbalanced in their arrangements.

(Evaluation of the Printed Matter)

Clarities of the printed matters were measured by clarity measuring device ICM-1T (made by Sofia measuring device Ltd.) by 2 mm slit width. The specular glossiness of the printed matter were measured by GMX-203 (made by Murakami color technology research Ltd.). Results are shown in Table 1.

TABLE 1

| | Specular glossiness | Clarity | Difference in specular glossiness | Difference in Clarity |
|---|---|---|---|---|
| Level B | 82 | 77 | 16 | 21 |
| Level C | 61 | 69 | 25 | 13 |
| Comparative | 43 | 45 | 54 | 31 |

In Table 1, the specular glossiness is an average of measured specular glossiness for the C, M, Y K color inks, and in respective colors, the measured specular glossiness for print rates of 25%, 50%, 100%, 200% are averaged.

The clarity is an average of measured clarity or the C, M, Y, K color inks, and in respective colors, measured clarity for print rates of 25%, 50%, 100%, 200% are averaged.

In Table 1, the difference in specular glossiness/clarity is a difference between the highest and the lowest about the specular glossiness/clarity in the measured specular glossiness/clarity.

Additionally, "comparative" in Table 1 is a result of a sample in which the clear ink was not used and otherwise was prepared in the same manner as example 1.

As shown in Table 1, the variation of the use ratio made it possible to control the specular glossiness and the clarity. The difference in both of the specular glossiness and the clarity of level B and level C are lower than that of the comparative. Thus, 100% area coverage brings reduction of the unevenness of the glossiness.

EXAMPLE 2

In Example 2, a further clear ink 3 having the composition shown below was used. The measured clarity of clear ink 3 was 65, and the measured specular glossiness of clear ink 3 was 50. The specular glossiness and clarity are measured by the same method as in example 1. The refractive index of clear ink 1 and clear ink 2 was approximately 1.5, and the refractive index of clear ink 3 was approximately 1.3.

(Composition of Clear Ink 3)

Dispersed fluorine clear ink 3 resin (approximately 20% density) (molecular weight: approximately 10000): 50 part.

Glycerin: 5 parts

Diethylene glycol: 7 parts

Surfactant (Acetylenol EH): 0.5 parts

Ion exchange water: 37.5 parts

In Example 2, a mixture of the three clear inks was applied. In the mixture, the use ratio was 1 (clear ink 1) to 5 (clear ink 2) to 1 (clear ink 3) for level B and the use ratio was 3 (clear ink 1) to 1 (clear ink 2) to 2 (clear ink 3) for level C. Example 2 was otherwise prepared in the same manner as example 1.

Figure 11A:
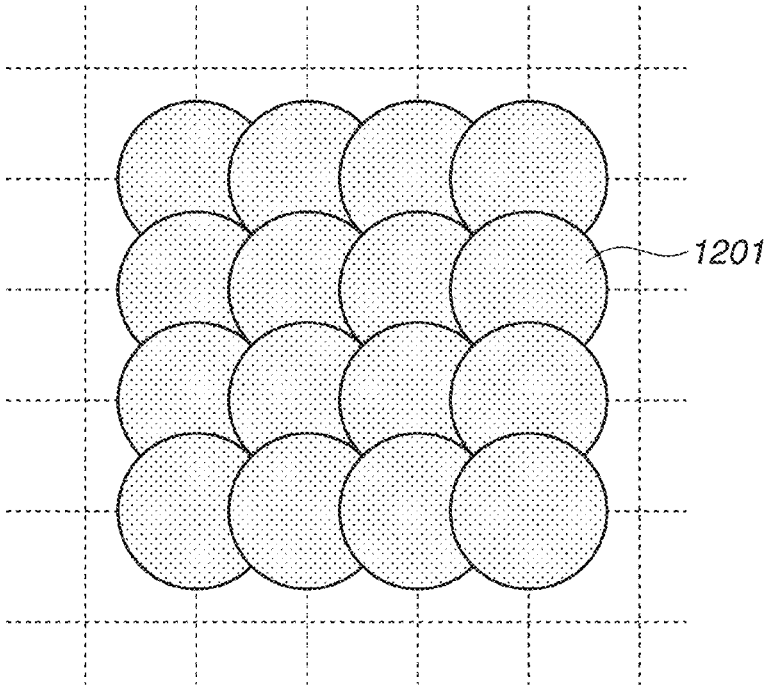
FIGS. 11A and 11B are schematic diagrams of applied clear ink on a print medium.
Figure 11B:
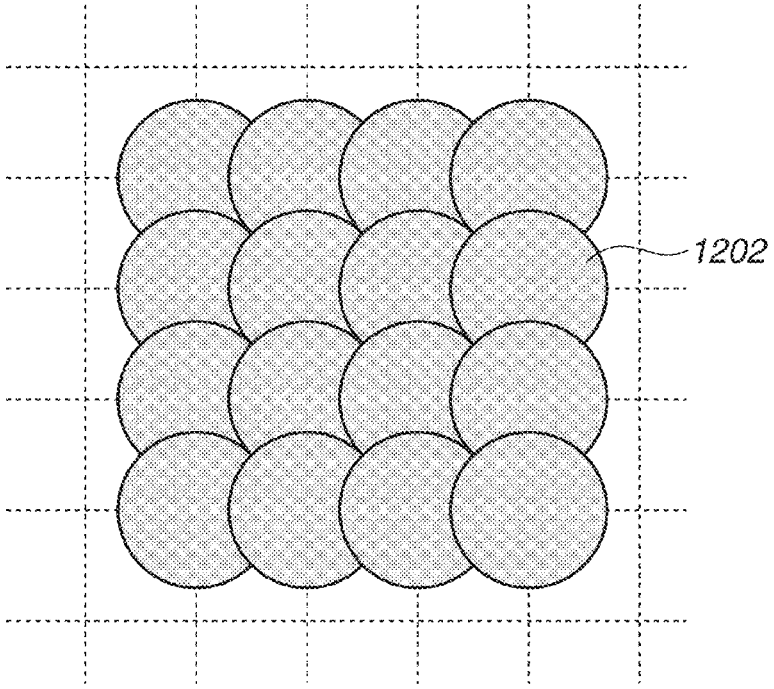

FIG. 11A shows a state of the applied clear ink on the print medium at level B, and FIG. 11B shows a state of applied clear ink on the print medium at level C. The Meaning of the grid lines in the FIGS. 11A and 11B are the same as that of the example 1. FIG. 11A shows a dot 1201 representing the mixture of the three clear inks. FIG. 11B shows a dot 1202 representing the mixture of the three clear inks.

Both of the FIGS. 11A and 12B show that 100% area coverage was achieved. The area ratio of clear ink 2 for level B was higher than that of level C, so that a degree of glossiness of the printed matter for level B was higher than that for level C.

Results of the evaluation are shown in Table 2. In Table 2, the meaning of the terms is the same as used in Table 1.

TABLE 2

| | Specular glossiness | Clarity | Difference in specular glossiness | Difference in Clarity |
|---|---|---|---|---|
| Level B | 84 | 80 | 17 | 19 |
| Level C | 61 | 69 | 25 | 13 |

As shown in the Table 2, variation of the mixture rate of the clear inks made it possible to control the specular glossiness and the clarity.

EXAMPLE 3

The image forming apparatus 1300 as shown in FIG. 12 was used. In example 3, a printed matter for level B, as explained in example 1 the ratio of clear ink 1 to clear ink 2 was 6 to 10, was formed. The color separation tables were generated for each of clear ink 1 and clear ink 2 in the image forming apparatus 1300 as explained for embodiment 3. Each generated table was used for the respective clear inks in the color separation process.

Figures 15A, 15B:
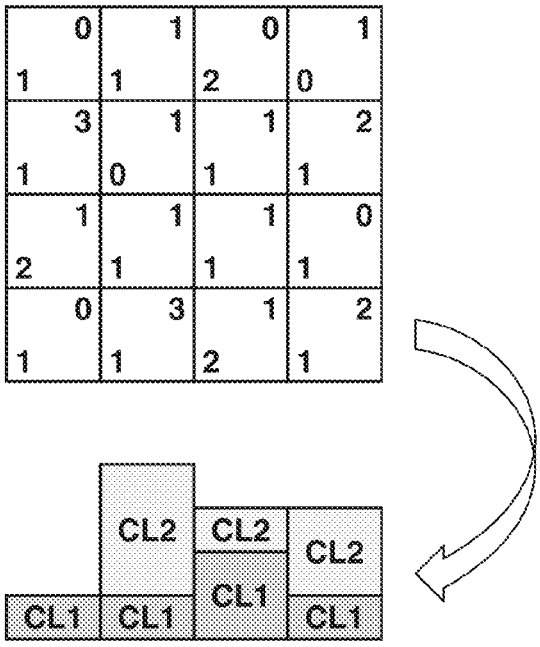
FIGS. 15A and 15B are schematic diagrams illustrating clear inks on a print medium in an example application.

FIG. 15A shows total amounts of the clear inks for respective pixels at four levels. FIG. 15B shows use ratio of clear ink 1 to clear ink 2. In each of the pixels, the upper right numeral is the use ratio of the clear ink 2 and the lower left numeral is the use ratio of the clear ink 1. Furthermore, FIG. 15B shows details for each pixel of the lowest row of pixels, in the form of layers. As shown in the FIG. 15B, the use ratios are different among each of the pixels corresponding to the upper right and lower right numerals shown pixel diagram. Example 3 was otherwise prepared in the same manner as the example 1.

Results of the evaluation are shown in Table 3. In the Table 3, the meaning of the items is the same as used in Table 1.

TABLE 3

| | Specular glossiness | Clarity | Difference in specular glossiness | Difference in Clarity |
|---|---|---|---|---|
| Example 3(Level B) | 82 | 78 | 6 | 10 |
| Example 1(Level B) | 82 | 77 | 16 | 21 |

As shown in the Table 3, example 3 achieves more reduction of unevenness of glossiness than example 1. The controlled variation of the application amounts of the two different clear inks for each of the pixels brings this greatly reduced unevenness of glossiness.

The scope of the following claims is to be accorded the broadest interpretation so as to encompass all such modifications and equivalent structures and functions.

This application claims the benefit of Japanese Patent Application No. 2015-167505, filed Aug. 27, 2015, which is hereby incorporated by reference herein in its entirety.

What is claimed is:

1. An image forming apparatus comprising:

a color ink applying unit configured to apply color ink to a print medium;

a clear ink applying unit configured to apply a plurality of clear inks to the print medium to cover the applied color ink, each clear ink of the plurality of clear inks having a degree of glossiness that is different from each other;

a glossiness data storage unit configured to store glossiness data of degree of glossiness of an image to be formed on the print medium; and a determining unit configured to:

determine an amount ratio of each clear ink to each other clear ink of the plurality of clear inks in accordance with the degree of glossiness indicated by the glossiness data stored in the glossiness data storage unit, and determine an amount of each clear ink of the plurality of clear inks such that the determined ratio is satisfied and such that the plurality of clear inks cover the applied color ink and print medium at approximately 100% area coverage.

2. The image forming apparatus according to claim 1, wherein the glossiness data storage unit stores respective glossiness data for each pixel to be formed on the print medium.

3. The image forming apparatus according to claim 1, wherein the determining unit determines the use ratio in accordance with a) the degree of glossiness indicated by the glossiness data and b) an amount of the color ink to be applied to the print medium, type of the print medium, or both the amount of the color ink to be applied to the print medium and the type of the print medium.

4. The image forming apparatus according to claim 1, wherein the clear ink applying unit applies the plurality of clear inks to the print medium by ejecting the plurality of clear inks.

5. The image forming apparatus according to claim 4, wherein the clear ink applying unit applies each of the clear inks of the plurality of clear inks to the print medium separately.

6. The image forming apparatus according to claim 5, wherein the plurality of clear inks comprises a first clear ink and a second clear ink having a lower degree of glossiness than the first clear ink, and wherein the clear ink applying unit applies the first clear ink prior to the second clear ink.

7. The image forming apparatus according to claim 1, wherein the clear ink applying unit mixes the plurality of clear inks and applies the mixed plurality of clear inks to the print medium.

8. The image forming apparatus according to claim 1, wherein the clear ink applying unit mixes the plurality of clear inks in accordance with the determined ratio.

9. The image forming apparatus according to claim 1, wherein the color ink applying unit applies a plurality of color inks to the print medium, each color ink of the plurality of color inks having a different color from each other, and the image forming apparatus further comprises a color separation unit configured to determine application amounts for each of the plurality of color inks such that the approximately 100% area coverage is satisfied based on an input image data including color information of an image to be formed on the print medium.

10. The image forming apparatus according to claim 9, wherein the color separation unit uses a plurality of color separation tables each color separation table corresponding to a respective clear ink of the plurality of clear inks, which defines a relationship between the input image data and the amount of the respective clear inks.

11. The image forming apparatus according to claim 10, wherein the determining unit generates the color separation tables in accordance with the determined ratio.

12. The image forming apparatus according to claim 1, wherein each clear ink of the plurality of clear inks comprises a resin, wherein each resin has a glass transition point that is different from each other, wherein the image forming apparatus further comprises a fixing unit configured to fix the plurality of clear inks on the print medium by heating the plurality of clear inks, wherein a heating temperature by the fixing unit is greater than the highest glass transition point of the resins, and wherein the heating is maintained until all of the resins of the plurality of clear inks reaches the temperature of the highest glass transition point.

13. An image forming method comprising:

applying color ink to a print medium;

applying a plurality of clear inks to the print medium to cover the applied color ink, each clear ink of the plurality of clear inks having a degree of glossiness that is different from each other;

storing glossiness data on degree of glossiness of an image to be formed on the print medium;

determining an amount ratio of each clear ink to each other clear ink of the plurality of clear inks in accordance with the degree of glossiness indicated by the glossiness data; and determining an amount of each clear ink of the plurality of clear inks such that the determined ratio is satisfied and such that the clear inks cover the applied color ink and print medium at approximately 100% area coverage.

* * * * *